US010488035B1

(12) United States Patent
Yang et al.

(10) Patent No.: US 10,488,035 B1
(45) Date of Patent: Nov. 26, 2019

(54) ILLUMINATION DEVICE AND DISPLAY SCREEN APPARATUS THEREOF

(71) Applicant: QISDA CORPORATION, Taoyuan (TW)

(72) Inventors: Rou-Ching Yang, Taipei (TW); Jiung-Cheng Pan, Taipei (TW)

(73) Assignee: Qisda Corporation, Taoyuan (TW)

( * ) Notice: Subject to any disclaimer, the term of this patent is extended or adjusted under 35 U.S.C. 154(b) by 0 days.

(21) Appl. No.: 15/990,839

(22) Filed: May 29, 2018

(30) Foreign Application Priority Data

May 14, 2018 (CN) ..... 2018 1 0456999

(51) Int. Cl.
*F21V 33/00* (2006.01)
*F21V 21/088* (2006.01)
*F21V 21/22* (2006.01)
*F21V 21/26* (2006.01)

(52) U.S. Cl.
CPC ..... *F21V 33/0052* (2013.01); *F21V 21/088* (2013.01); *F21V 21/22* (2013.01); *F21V 21/26* (2013.01)

(58) Field of Classification Search
CPC ..... F21V 33/0052; F21V 21/26; F21V 21/28; F21V 21/30; F21V 21/116; F21V 21/14; F21S 6/003; F21S 6/006
See application file for complete search history.

(56) References Cited

U.S. PATENT DOCUMENTS 5,863,110 A * 1/1999 Swanson ..... F21V 21/02 362/269
6,203,175 B1 * 3/2001 Basacchi ..... F21S 9/02 362/287
6,203,179 B1 * 3/2001 Swanson ..... F21V 21/02 362/147
7,066,619 B2 * 6/2006 Waters ..... F21S 8/033 362/147
D563,582 S * 3/2008 Levine ..... D26/63
2006/0256584 A1 * 11/2006 Paoluccio ..... F21S 2/005 362/652
2010/0202146 A1 * 8/2010 Gobindram ..... F21S 6/003 362/249.03
2011/0051435 A1 * 3/2011 Pfund ..... F21S 6/003 362/418
2015/0362148 A1 * 12/2015 Katz ..... F21S 6/003 362/16

FOREIGN PATENT DOCUMENTS

CN 203190350 U 9/2013
CN 107631190 A 1/2018

* cited by examiner

*Primary Examiner* — William N Harris

(57) ABSTRACT

An illumination device connected to a display screen having a front display surface and a rear installation surface parallel to each other includes a light source, a mounting plate, and a support mechanism. The light source emits light to form an illumination area defined by a first illumination boundary close to the front display surface and a second illumination boundary away from the front display surface. The mounting plate is detachably attached to the rear installation surface. The support mechanism is connected to the light source and the mounting plate respectively, for keeping the first illumination boundary parallel to the front display surface or inclined outwardly at a first inclined angle relative to the front display surface.

20 Claims, 10 Drawing Sheets

ILLUMINATION DEVICE AND DISPLAY SCREEN APPARATUS THEREOF

BACKGROUND OF THE INVENTION

1. Field of the Invention

The present invention relates to an illumination device and a display screen apparatus thereof, and more specifically, to an illumination device utilizing a support mechanism to prevent light of a light source from being incident to a display screen and a display screen apparatus thereof.

2. Description of the Prior Art

In general, conventional illumination devices are usually immobile and have a relatively large volume, such as drop lamps, recessed lamps, table lamps and so on. For cases in which a user just needs intensive illumination to a viewing area, a table lamp nearby is usually used for the required illumination. Currently, lamps capable of being fixed on monitors for use are available on the market. For example, when a small USB lamp which includes a flexible tube, a USB connector at one end of the flexible tube, and a light source (e.g. an LED lamp) at the other end of the flexible tube is used for illumination, the USB connector is connected to a USB port of a host (e.g. a desktop computer or a notebook), and a user can bend the flexible tube such that the light source can provide sufficient illumination toward the viewing area.

However, in the aforesaid design, since the illumination angle of the light source varies with bending of the flexible tube, light of the light source may be directly incident to the monitor and then be reflected to the eyes of the user to generate the glaring problem, so as to cause the user much uncomfortable in viewing the monitor.

SUMMARY OF THE INVENTION

The present invention provides an illumination device connected to a display screen having a front display surface and a rear installation surface parallel to each other. The illumination device includes a light source, a mounting plate and a support mechanism. The light source emits light to form an illumination area. The illumination area is defined by a first illumination boundary close to the front display surface and a second illumination boundary away from the front display surface. The mounting plate is detachably attached to the rear installation surface. The support mechanism is connected to the light source and the mounting plate respectively for keeping the first illumination boundary parallel to the front display surface or inclined outwardly at a first inclined angle relative to the front display surface.

The present invention further provides a display screen apparatus including a display screen and an illumination device. The display screen has a front display surface and a rear installation surface parallel to each other. The illumination device includes a light source, a mounting plate and a support mechanism. The light source emits light to form an illumination area. The illumination area is defined by a first illumination boundary close to the front display surface and a second illumination boundary away from the front display surface. The mounting plate is detachably attached to the rear installation surface. The support mechanism is connected to the light source and the mounting plate respectively for keeping the first illumination boundary parallel to the front display surface or inclined outwardly at a first inclined angle relative to the front display surface.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
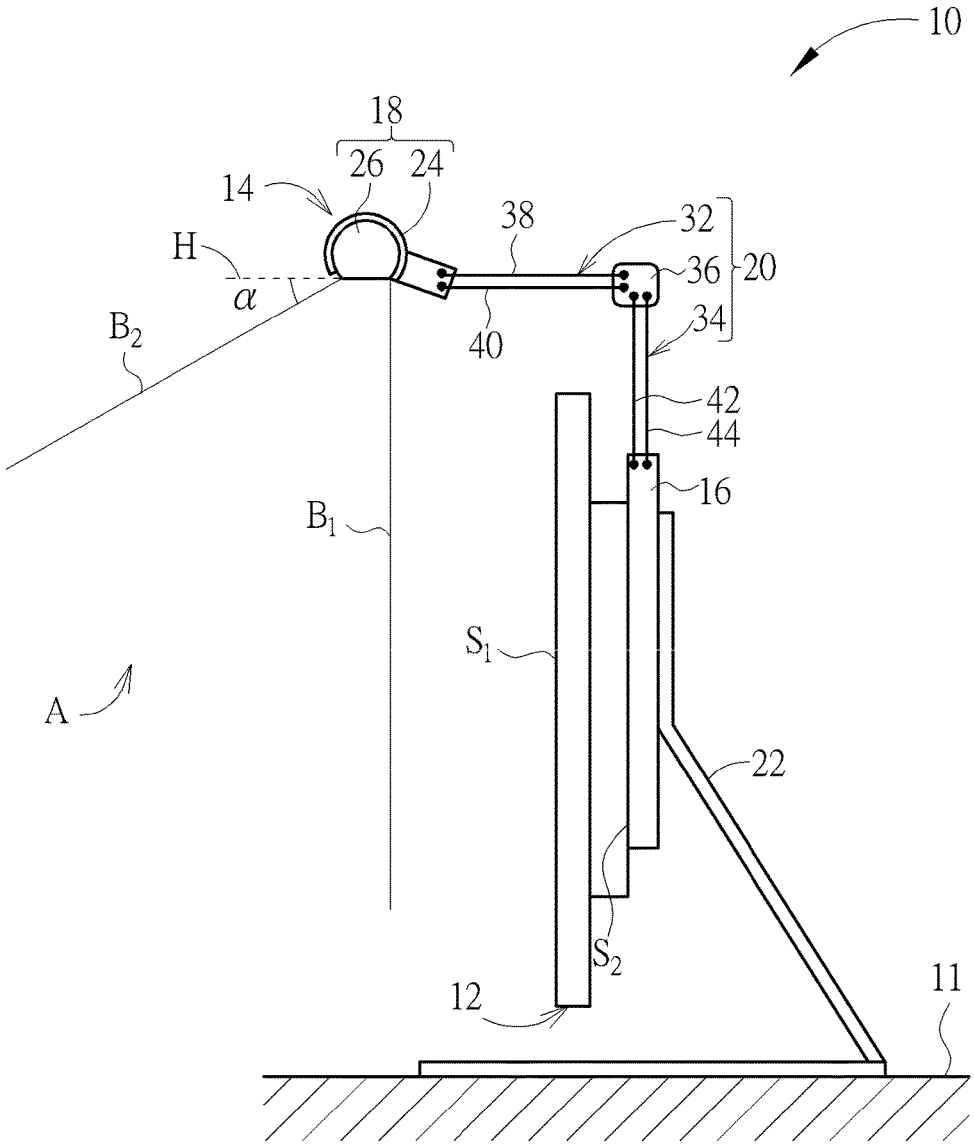
FIG. 1 is a side view of a display screen apparatus according to an embodiment of the present invention.
Figure 2:
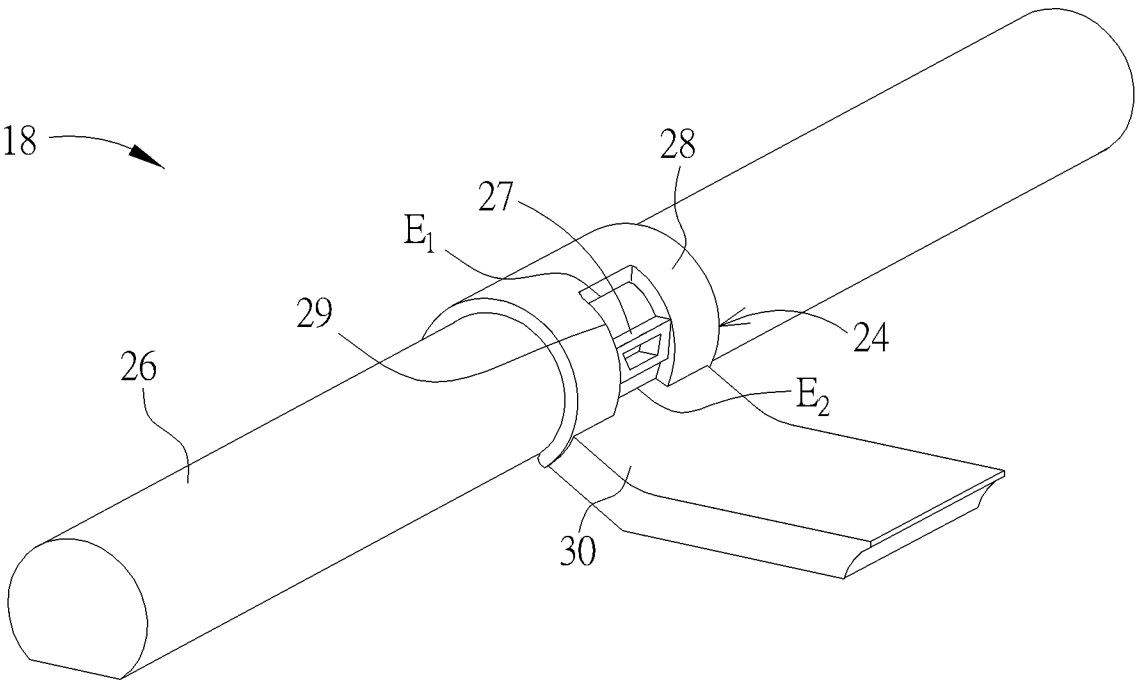
FIG. 2 is a partial enlarged diagram of a light source in FIG. 1.

Please refer to FIG. 1 and FIG. 2. FIG. 1 is a side view of a display screen apparatus 10 according to an embodiment of the present invention. FIG. 2 is a partial enlarged diagram of a light source 18 in FIG. 1. As shown in FIG. 1 and FIG. 2, the display screen apparatus 10 includes a display screen 12 and an illumination device 14. The display screen 12 could preferably be a computer monitor (but not limited thereto) to display images for a user to view, and has a front display surface $S_1$ and a rear installation surface $S_2$ parallel to each other. The illumination device 14 includes a mounting plate 16, the light source 18, and a support mechanism 20. The mounting plate 16 is detachably attached to the rear installation surface $S_2$ (e.g. by screws), and connection of the mounting plate 16 and the rear installation surface $S_2$ preferably conforms to VESA (Video Electronics Standards Association) mount specification. In this embodiment, as shown in FIG. 1, the display screen apparatus 10 could further include a support stand 22, but not limited thereto, meaning that the present invention could adopt other screen mounting design in another embodiment, such as utilizing a support arm detachably assembled with the rear installation surface $S_2$ for mounting the display screen 12 on a support wall. The support stand 22 is detachably assembled with the rear installation surface $S_2$ (e.g. by screws) for mounting the display screen 12 on a support surface 11, such as on a desk, and the mounting plate 16 is detachably sandwiched between the support stand 22 and the rear installation surface $S_2$.

The light source 18 is used for emitting light to form an illumination area A to provide sufficient illumination. As shown in FIG. 1, the illumination area A is defined by a first illumination boundary $B_1$ close to the front display surface $S_1$ and a second illumination boundary $B_2$ away from the front display surface $S_2$. In this embodiment, the second illumination boundary $B_2$ could form an inclined angle $\alpha$ with a horizontal surface H (as shown in FIG. 1), and the inclined angle $\alpha$ could preferably be less than 90° and is larger than or equal to 30°, so as to efficiently prevent light of light source 18 from being directly incident to the eyes of the user.

Figure 3:
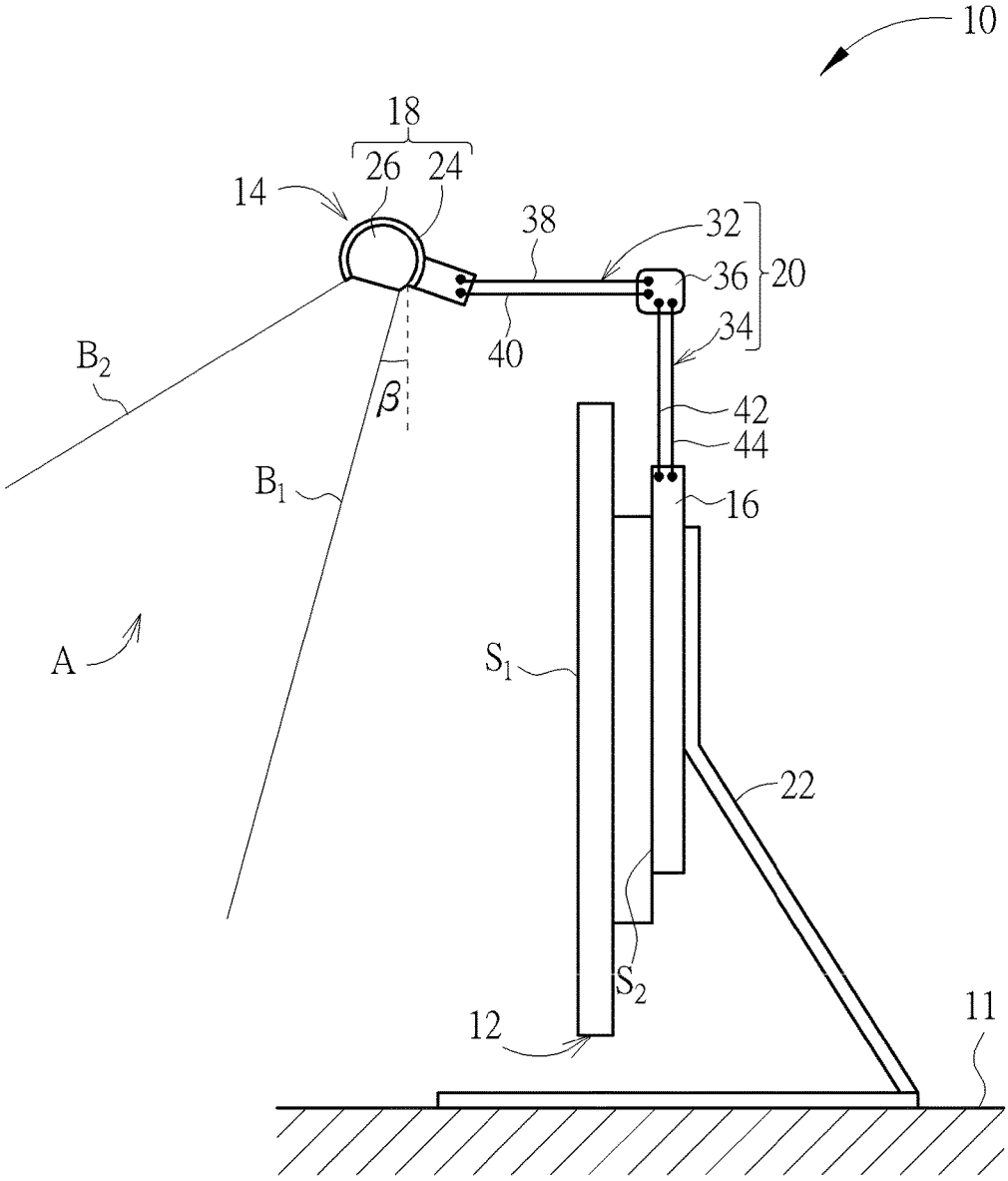
FIG. 3 is a side view of the display screen apparatus in FIG. 1 when the light source rotates to make a first illumination boundary inclined outwardly at an inclined angle relative to a front display surface.

In practical application, for further improving flexibility of the light source 18 in adjusting the illumination area A, the light source 18 could preferably adopt a rotatable design (but not limited thereto). For example, please refer to FIG. 2 and FIG. 3. FIG. 3 is a side view of the display screen apparatus 10 in FIG. 1 when the light source 18 rotates to make the first illumination boundary $B_1$ inclined outwardly at an inclined angle $\beta$ relative to the front display surface $S_1$. As shown in FIG. 2 and FIG. 3, the light source 18 could include a connection structure 24 and a light bar 26 (e.g. an LED light bar). The connection structure 24 could preferably have a C-shaped clamp portion 28 and a connection arm portion 30. The light bar 26 is rotatably clamped in the C-shaped clamp portion 28, so that the user can rotate the light bar 26 to make the first illumination boundary $B_1$ inclined outwardly at an inclined angle $\beta$ relative to the front display surface $S_1$. Accordingly, the user can properly adjust the inclined angle $\beta$ by rotating the light bar 26 to surely prevent light of the light bar 26 from being directly incident to the front display surface $S_1$. The connection arm portion 30 extends from the C-shaped clamp portion 28 to be connected to the support mechanism 20.

Moreover, for preventing over-rotation of the light bar 26, as shown in FIG. 2, the light bar 26 could have a limiting structure 27, and the C-shaped clamp portion 28 could have a limiting opening 29. The limiting structure 27 could preferably be a USB port for receiving external electric power through a USB cable inserted into the limiting structure 27. The limiting structure 27 is movably inserted into the limiting opening 29 to selectively abut against an upper edge $E_1$ or a lower edge $E_2$ of the limiting opening 29 for limiting a rotation range of the light bar 26 clamped in the C-shaped clamp portion 28.

The related description for the mechanical design of the support mechanism 20 is provided as follows. The support mechanism 20 is connected to the light source 18 and the mounting plate 16 respectively for keeping the first illumination boundary $B_1$ parallel to the front display surface $S_1$ as shown in FIG. 1 or inclined outwardly at the inclined angle $\beta$ relative to the front display surface $S_1$ as shown in FIG. 3. In this embodiment, the present invention could preferably adopt an adjustable support mechanical design for allowing that the user can adjust the light source 18 to a desired position, but not limited thereto, meaning that the present invention could adopt a non-adjustable support structural design (e.g. the support mechanism 20 could be a rigid bending arm) in another embodiment.

As shown in FIG. 1, the support mechanism 20 includes a first rod structure 32, a second rod structure 34, and a bridge structure 36. The first rod structure 32 is connected to the light source 18. The second rod structure 34 is connected to the mounting plate 16. The bridge structure 36 is movably connected to the first rod structure 32 and the second rod structure 34. To be more specific, the first rod structure 32 includes a first linkage rod 38 and a second linkage rod 40 pivoted to the connection arm portion 30 respectively, and the second rod structure 34 includes a third linkage rod 42 and a fourth linkage rod 44 pivoted to the mounting plate 16 respectively. The bridge structure 36 is pivoted to the first linkage rod 38 and the second linkage rod 40 respectively to form a parallelogram linkage mechanism cooperatively with the first linkage rod 38, the second linkage rod 40, and the light source 18, so as to make the first linkage rod 38 and the second linkage rod 40 swingable in parallel. Furthermore, the bridge structure 36 is pivoted to the third linkage rod 42 and the fourth linkage rod 44 respectively to form a parallelogram linkage mechanism cooperatively with the third linkage rod 42 and the fourth linkage rod 44, and the mounting plate 16, so as to make the third linkage rod 42 and the fourth linkage rod 44 swingable in parallel.

Figure 4:
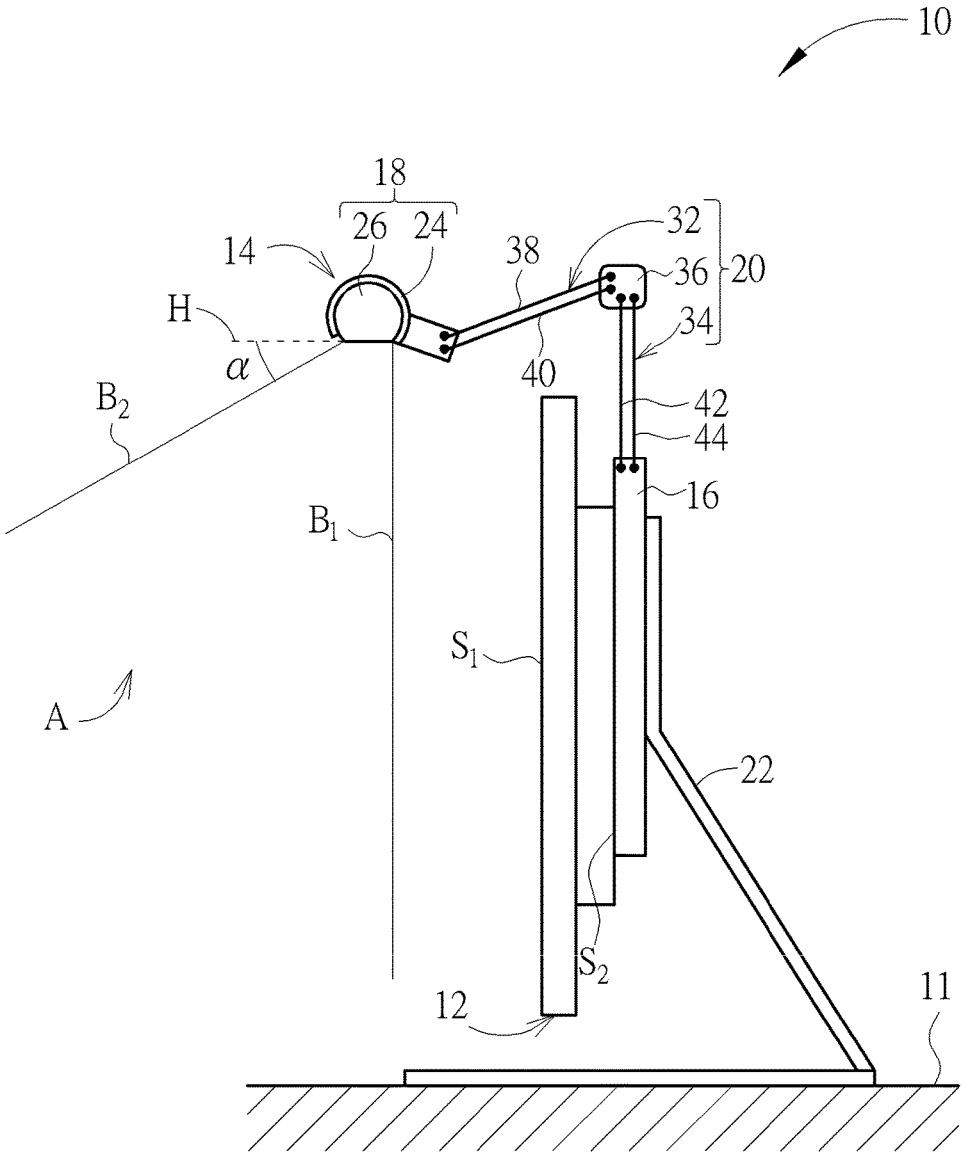
FIG. 4 is a side view of the display screen apparatus in FIG. 1 when the light source is pressed downward.
Figure 5:
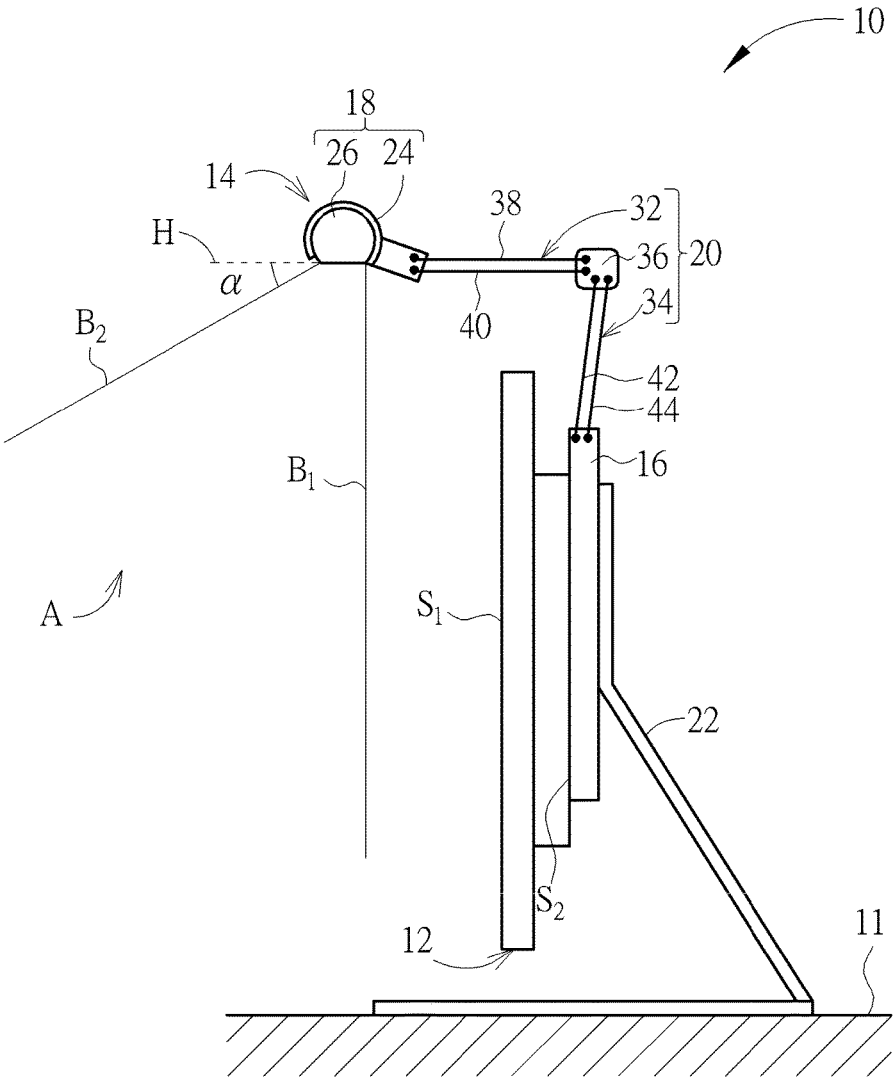
FIG. 5 is a side view of the display screen apparatus in FIG. 1 when the light source is pushed backward.

Via the aforesaid linkage design, the support mechanism 20 can keep the first illumination boundary $B_1$ parallel to the front display surface $S_1$ (or inclined outwardly relative to the front display surface $S_1$ when the user rotates the light bar 26 by the inclined angle $\beta$) when the user adjusts the light source 18 to a desired position. For example, if the light source 18 is pressed from a position as shown in FIG. 1 downward to a position as shown in FIG. 4, the first linkage rod 38 and the second linkage rod 40 can swing in parallel with downward movement of the light source 18 to keep the first illumination boundary $B_1$ parallel to the front display surface $S_1$ (or inclined outwardly relative to the front display surface $S_1$ when the user rotates the light bar 26 by the inclined angle $\beta$). On the other hand, if the light source 18 is pushed from the position as shown in FIG. 1 backward to a position as shown in FIG. 5, the third linkage rod 42 and the fourth linkage rod 44 can swing in parallel with backward movement of the light source 18 to keep the first illumination boundary $B_1$ parallel to the front display surface $S_1$ (or inclined outwardly relative to the front display surface $S_1$ when the user rotates the light bar 26 by the inclined angle $\beta$). As for the related description for other adjusting operations (e.g. lifting the light source 18 upward or pulling the light source 18 forward), it could be reasoned by analogy according to the aforesaid description and omitted herein.

In summary, since the first illumination boundary $B_1$ is always kept parallel to the front display surface $S_1$ (or inclined outwardly relative to the front display surface $S_1$ when the user rotates the light bar 26 by the inclined angle $\beta$) no matter how the user moves the light source 18, the present invention can surely prevent light of the light bar 26 from being directly incident to the front display surface $S_1$, so as to efficiently solve the glaring problem aforementioned in the prior art. In such a manner, comfort in viewing the display screen 12 can be greatly improved.

Figure 6:
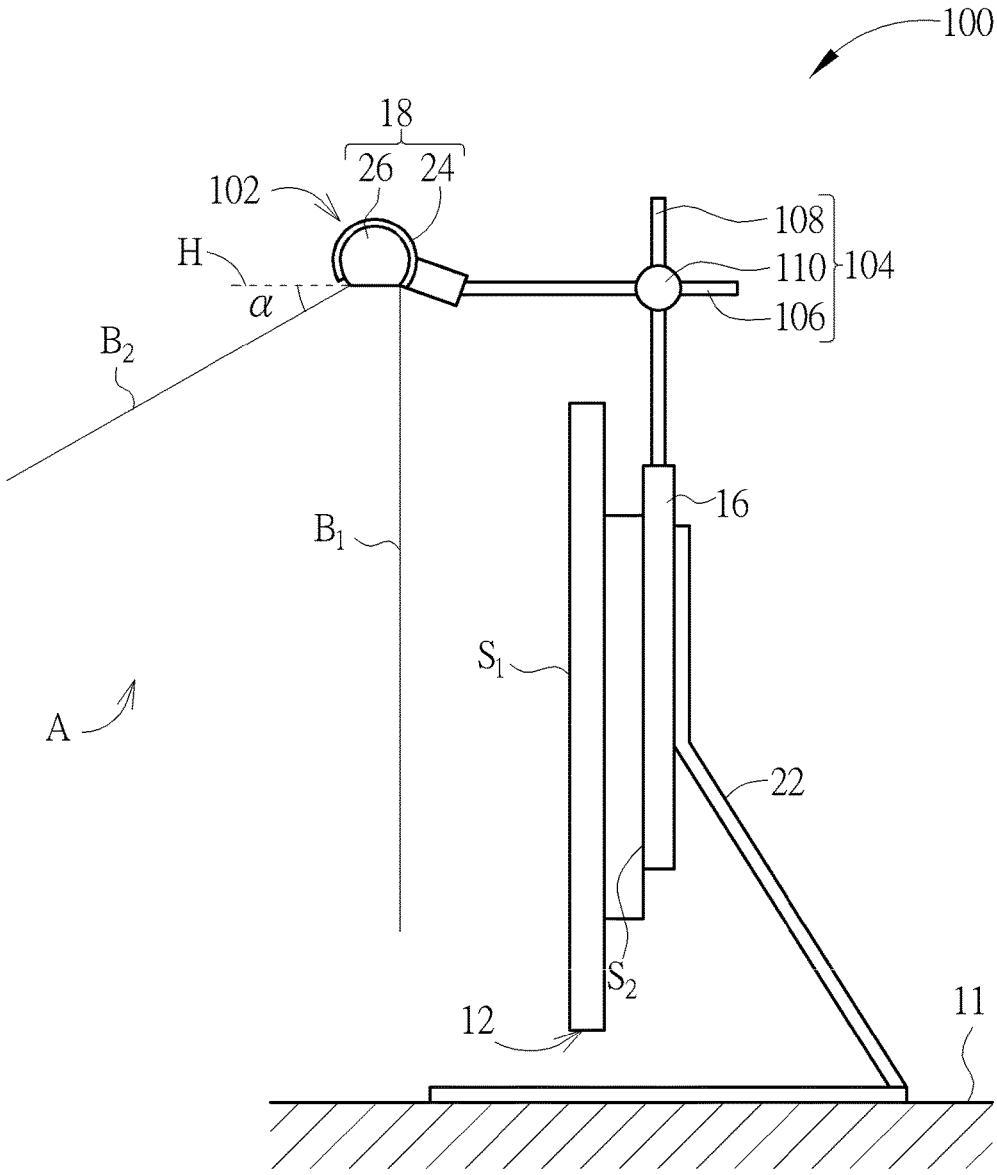
FIG. 6 is a side view of a display screen apparatus according to another embodiment of the present invention.
Figure 7:
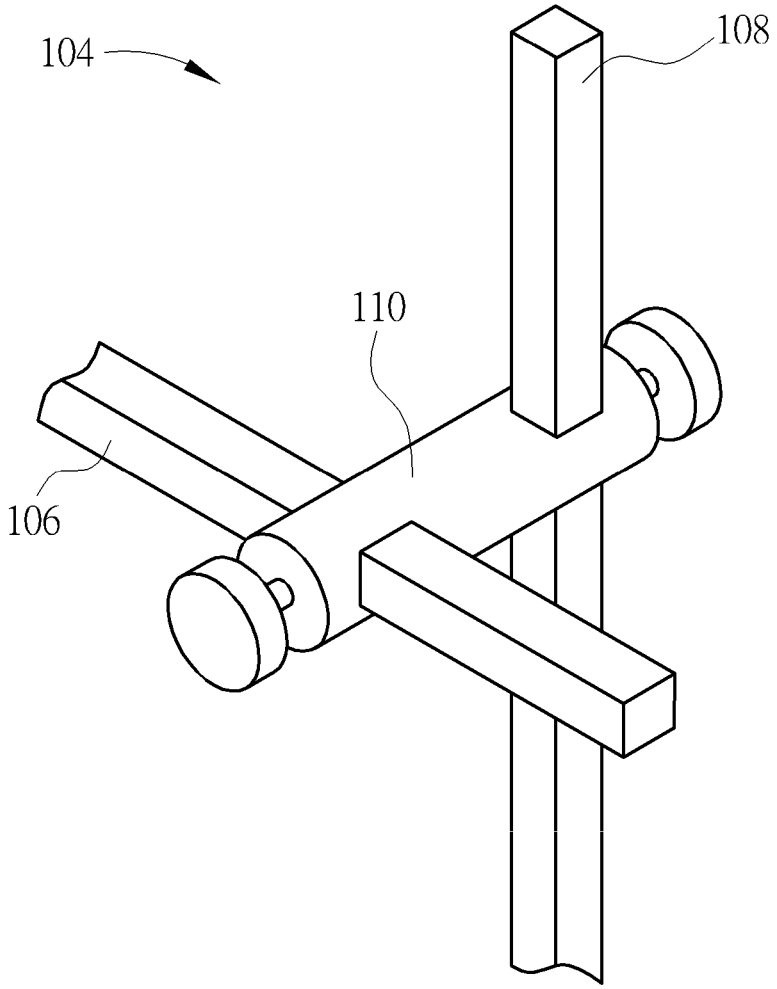
FIG. 7 is a partial enlarged diagram of a support mechanism in FIG. 6.

The mechanical design of the support mechanism is not limited to the aforesaid embodiment. Please refer to FIG. 6 and FIG. 7. FIG. 6 is a side view of a display screen apparatus 100 according to another embodiment of the present invention. FIG. 7 is a partial enlarged diagram of a support mechanism 104 in FIG. 6. Components both mentioned in this embodiment and the aforesaid embodiment represent components with similar structures or functions, and the related description is omitted herein. As shown in FIG. 6 and FIG. 7, the display screen apparatus 100 includes the display screen 12, the support stand 22, and an illumination device 102. The illumination device 102 includes the mounting plate 16, the light source 18, and a support mechanism 104. The support mechanism 104 includes a first rod structure 106, a second rod structure 108, and a bridge structure 110. In this embodiment, the first rod structure 106 is slidably disposed through the bridge structure 110 and perpendicular to the front display surface $S_1$, and the second rod structure 108 is slidably disposed through the bridge structure 110 and parallel to the front display surface $S_1$.

Via the aforesaid design, no matter the light source 18 is pulled forward or pushed backward relative to the display screen 12, the first rod structure 106 can slide perpendicular to the front display surface $S_1$ relative to the bridge structure 110 to keep the first illumination boundary $B_1$ parallel to the front display surface $S_1$ (or inclined outwardly relative to the front display surface $S_1$ when the user rotates the light bar 26 by the inclined angle β). On the other hand, no matter the light source 18 is lifted upward or pressed downward relative to the display screen 12, the bridge structure 110 can slide along the second rod structure 108 parallel to the front display surface $S_1$ to keep the first illumination boundary $B_1$ parallel to the front display surface $S_1$ (or inclined outwardly relative to the front display surface $S_1$ when the user rotates the light bar 26 by the inclined angle β). In such a manner, the purpose of preventing light of the light bar 26 from being directly incident to the front display surface $S_1$ can be achieved, so as to efficiently solve the glaring problem aforementioned in the prior art.

Figure 8:
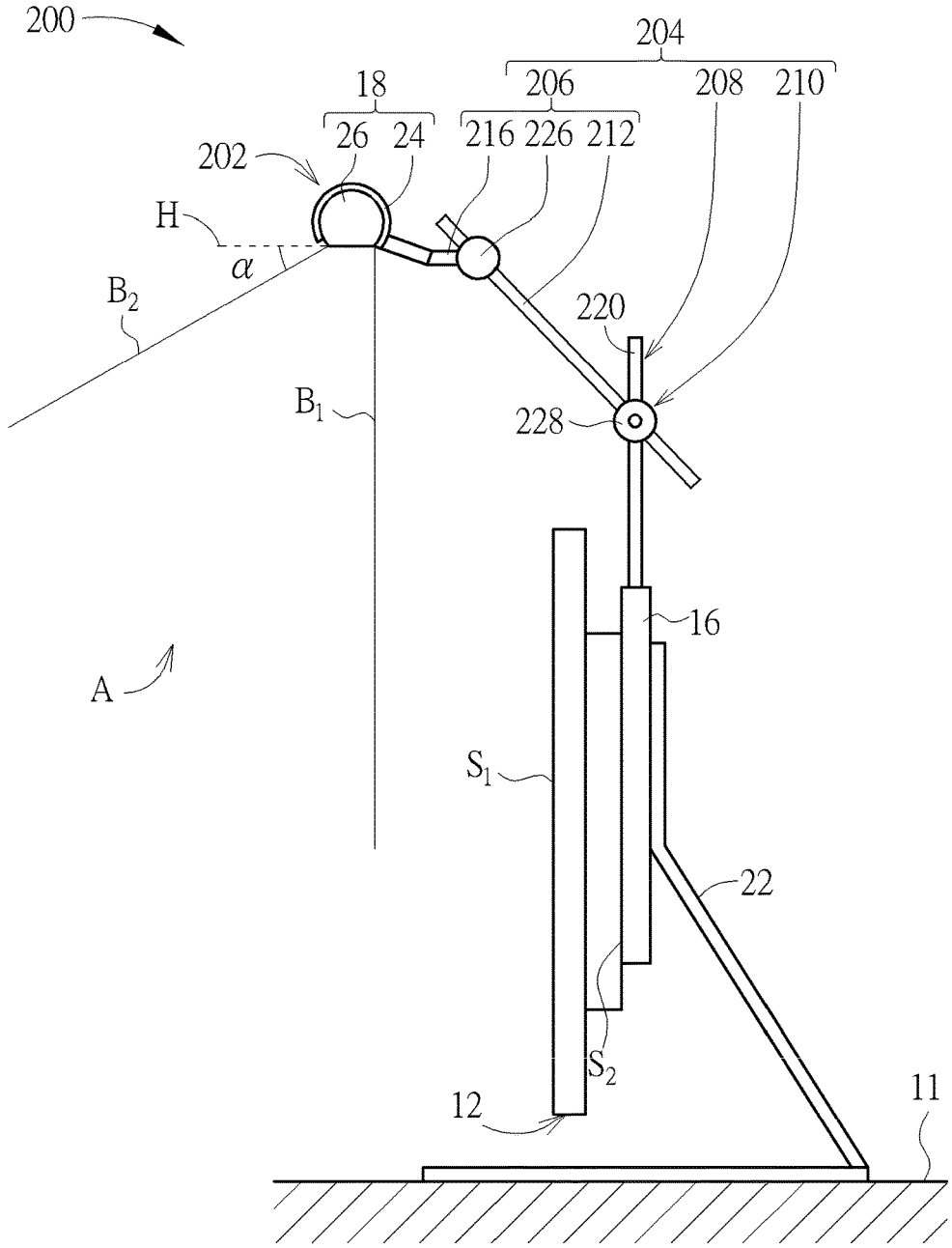
FIG. 8 is a side view of a display screen apparatus according to another embodiment of the present invention.
Figure 9:
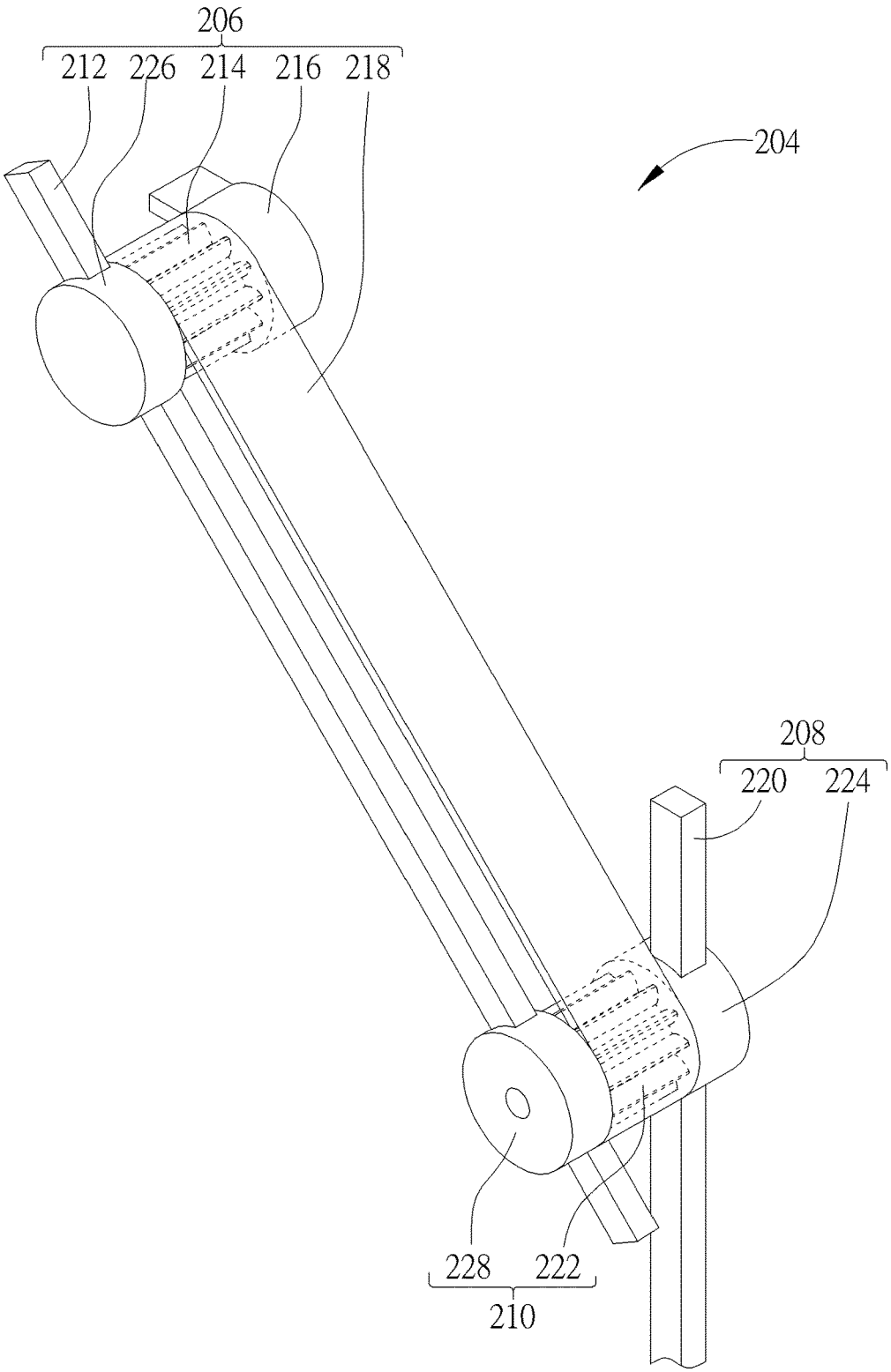
FIG. 9 is a partial enlarged diagram of a support mechanism in FIG. 8.
Figure 10:
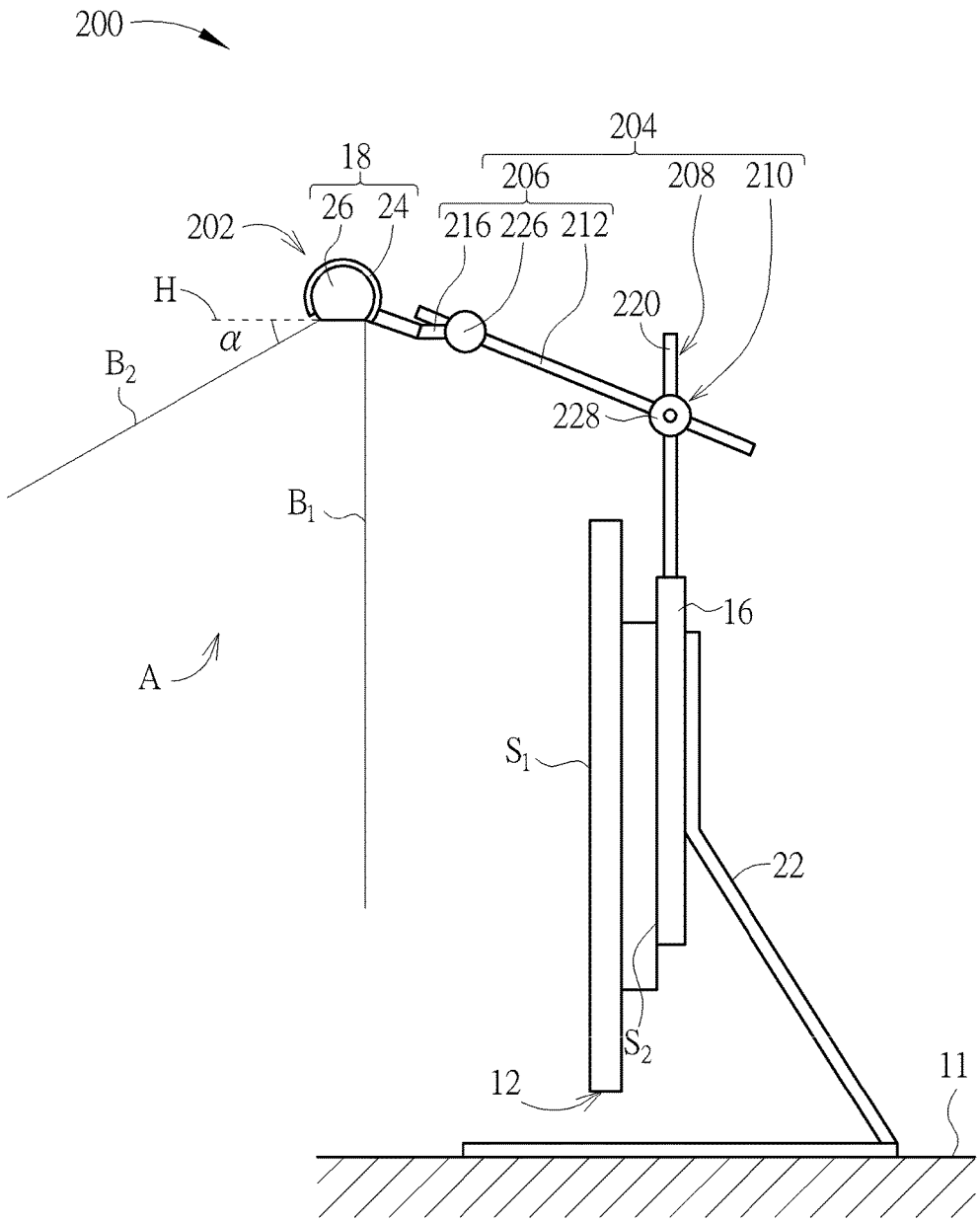
FIG. 10 is a side view of the display screen apparatus in FIG. 8 when the light source is pressed downward.

Furthermore, please refer to FIG. 8, FIG. 9, and FIG. 10. FIG. 8 is a side view of a display screen apparatus 200 according to another embodiment of the present invention. FIG. 9 is a partial enlarged diagram of a support mechanism 204 in FIG. 8. FIG. 10 is a side view of the display screen apparatus 200 in FIG. 8 when the light source 18 is pressed downward. Components both mentioned in this embodiment and the aforesaid embodiments represent components with similar structures or functions, and the related description is omitted herein. As shown in FIG. 8 and FIG. 9, the display screen apparatus 200 includes the display screen 12, the support stand 22, and an illumination device 202. The illumination device 202 includes the mounting plate 16, the light source 18, and a support mechanism 204. The support mechanism 204 includes a first rod structure 206, a second rod structure 208, and abridge structure 210. In this embodiment, the first rod structure 206 includes a first rod 212, a first pulley 214, a connection block 216 and a belt 218, the second rod structure 208 includes a second rod 220, and the bridge structure 210 includes a second pulley 222. The first pulley 214 is pivoted to the first rod 212. The connection block 216 is fixed to the first pulley 214 and the light source 18 respectively. The belt 218 is wound on the first pulley 214 and the second pulley 222 to form a pulley transmission mechanism, and the second pulley 222 is non-rotatably connected to the second rod 220 and pivoted to the first rod 212.

Via the aforesaid design, no matter the light source 18 is pressed downward or lifted upward relative to the display screen 12, the support mechanism 204 can keep the first illumination boundary $B_1$ parallel to the front display surface $S_1$ (or inclined outwardly relative to the front display surface $S_1$ when the user rotates the light bar 26 by the inclined angle β). For example, if the light source 18 is pressed from a position as shown in FIG. 8 downward to a position as shown in FIG. 10, the first rod 212 as shown in FIG. 9 rotates counterclockwise relative to the second rod 220 via the second pulley 222. At this time, since the second pulley 222 is non-rotatably connected to the second rod 220, the first pulley 214 rotates clockwise on the first rod 212 via engagement of the belt 218 with the second pulley 222 (during this process, the belt 218 is engaged with teeth of the second pulley 222 in turn with counterclockwise rotation of the first rod 212). Accordingly, the connection block 216 rotates clockwise with rotation of the first pulley 214, so as to rotate the light source 18 from a position as shown in FIG. 8 clockwise to a position as shown in FIG. 10 for keeping the first illumination boundary $B_1$ parallel to the front display surface $S_1$ (or inclined outwardly relative to the front display surface $S_1$ when the user rotates the light bar 26 by the inclined angle β). In such a manner, the purpose of preventing light of the light bar 26 from being directly incident to the front display surface $S_1$ can be achieved, so as to efficiently solve the glaring problem aforementioned in the prior art.

In practical application, the second rod structure 208 could further include a sliding block 224, the second rod 220 could be parallel to the front display surface $S_1$ and slidably disposed through the sliding block 224, and the second pulley 222 could be non-rotatably connected to the sliding block 224. As such, when the user slides the sliding block 224 upward or downward along the second rod 220 for adjusting the height of the light source 18, the light source 18 moves parallel to the front display surface $S_1$ relative to the display screen 12 to keep the first illumination boundary $B_1$ parallel to the front display surface $S_1$ (or inclined outwardly relative to the front display surface $S_1$ when the user rotates the light bar 26 by the inclined angle β).

Moreover, as shown in FIG. 8, the first rod structure 206 could further include a first sliding block 226, and the bridge structure 210 could further include a second sliding block 228. The first pulley 214 is pivoted to the first sliding block 226, the second pulley 222 is pivoted to the second sliding block 228, and the first sliding block 226 and the second sliding block 228 are slidably disposed on the first rod 212. Via the aforesaid design, the user can properly adjust a distance between the first pulley 214 and the second pulley 222 by sliding the first sliding block 226 or the second sliding block 228 along the first rod 212, for adjusting the height of the light source 18.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An illumination device connected to a display screen having a front display surface and a rear installation surface parallel to each other, the illumination device comprising:

a light source for emitting light to form an illumination area, the illumination area being defined by a first illumination boundary close to the front display surface and a second illumination boundary away from the front display surface;

a mounting plate detachably attached to the rear installation surface; and a support mechanism connected to the light source and the mounting plate respectively, for keeping the first illumination boundary parallel to the front display surface or inclined outwardly at a first inclined angle relative to the front display surface.

2. The illumination device of claim 1, wherein the support mechanism comprises:

a first rod structure connected to the light source;

a second rod structure connected to the mounting plate; and a bridge structure movably connected to the first rod structure and the second rod structure, for keeping the first illumination boundary parallel to the front display surface or inclined outwardly at the first inclined angle relative to the front display surface when the light source moves relative to the display screen via linkage of the bridge structure with the first and second rod structures.

3. The illumination device of claim 2, wherein the first rod structure comprises a first linkage rod and a second linkage rod pivoted to the light source respectively, the second rod structure comprises a third linkage rod and a fourth linkage rod pivoted to the mounting plate respectively, and the bridge structure is pivoted to the first and second linkage rods respectively to make the first and second linkage rods swingable in parallel and is pivoted to the third and fourth linkage rods respectively to make the third and fourth linkage rods swingable in parallel;

wherein when the light source is lifted upward or is pressed downward relative to the display screen, the first and second linkage rods swing in parallel with movement of the light source to keep the first illumination boundary parallel to the front display surface or inclined outwardly at the first inclined angle;

when the light source is pulled forward or is pushed backward relative to the display screen, the third and fourth linkage rods swing in parallel with movement of the light source to keep the first illumination boundary parallel to the front display surface or inclined outwardly at the first inclined angle.

4. The illumination device of claim 2, wherein the first rod structure is slidably disposed through the bridge structure and perpendicular to the front display surface, and the second rod structure is slidably disposed through the bridge structure and parallel to the front display surface;

wherein when the light source is pulled forward or pushed backward relative to the display screen, the first rod structure slides perpendicular to the front display surface relative to the bridge structure to keep the first illumination boundary parallel to the front display surface or inclined outwardly at the first inclined angle;

when the light source is lifted upward or pressed downward relative to the display screen, the bridge structure slides along the second rod structure parallel to the front display surface to keep the first illumination boundary parallel to the front display surface or inclined outwardly at the first inclined angle.

5. The illumination device of claim 2, wherein the first rod structure comprises a first rod, a first pulley, a connection block and a belt, the second rod structure comprises a second rod, the bridge structure comprises a second pulley, the first pulley is pivoted to the first rod, the connection block is fixed to the first pulley and the light source respectively, the belt is wound on the first pulley and the second pulley, and the second pulley is non-rotatably connected to the second rod and pivoted to the first rod;

wherein when the first rod rotates in a direction relative to the second rod via the second pulley, the first pulley rotates in an opposite direction via engagement of the belt with the second pulley, and the light source rotates together with the first pulley via the connection block to keep the first illumination boundary parallel to the front display surface or inclined outwardly at the first inclined angle.

6. The illumination device of claim 5, wherein the second rod structure further comprises a sliding block, the second rod is parallel to the front display surface and slidably disposed through the sliding block, the second pulley is non-rotatably connected to the sliding block, and when the sliding block slides upward or downward along the second rod, the light source moves parallel to the front display surface relative to the display screen to keep the first illumination boundary parallel to the front display surface or inclined outwardly at the first inclined angle.

7. The illumination device of claim 5, wherein the first rod structure further comprises a first sliding block, the bridge structure further comprises a second sliding block, the first pulley is pivoted to the first sliding block, the second pulley is pivoted to the second sliding block, and the first and second sliding blocks are slidably disposed on the first rod for adjusting a distance between the first pulley and the second pulley.

8. The illumination device of claim 2, wherein the light source comprises a connection structure and a light bar, the connection structure has a C-shaped clamp portion and a connection arm portion, the light bar is rotatably clamped in the C-shaped clamp portion for adjusting the first inclined angle, and the connection arm portion extends from the C-shaped clamp portion to be connected to the first rod structure.

9. The illumination device of claim 8, wherein the light bar has a limiting structure, the C-shaped clamp portion has a limiting opening, and the limiting structure is movably inserted into the limiting opening to selectively abut against an upper edge or a lower edge of the limiting opening for limiting a rotation range of the light bar clamped in the C-shaped clamp portion.

10. The illumination device of claim 1, wherein the second illumination boundary forms a second inclined angle with a horizontal surface, and the second inclined angle is less than 90° and is larger than or equal to 30°.

11. The illumination device of claim 1, wherein the display screen further has a support arm or a support stand detachably assembled with the rear installation surface for mounting the display screen, and the mounting plate is connected to the support arm or the support stand to be detachably attached to the rear installation surface.

12. A display screen apparatus comprising:

a display screen having a front display surface and a rear installation surface parallel to each other; and an illumination device comprising:

a light source for emitting light to form an illumination area, the illumination area being defined by a first illumination boundary close to the front display surface and a second illumination boundary away from the front display surface;

a mounting plate detachably attached to the rear installation surface; and a support mechanism connected to the light source and the mounting plate respectively, for keeping the first illumination boundary parallel to the front display surface or inclined outwardly at a first inclined angle relative to the front display surface.

13. The display screen apparatus of claim 12, wherein the support mechanism comprises:

a first rod structure connected to the light source;

a second rod structure connected to the mounting plate; and a bridge structure movably connected to the first rod structure and the second rod structure, for keeping the first illumination boundary parallel to the front display surface or inclined outwardly at the first inclined angle relative to the front display surface when the light source moves relative to the display screen via linkage of the bridge structure with the first and second rod structures.

14. The display screen apparatus of claim 13, wherein the first rod structure comprises a first linkage rod and a second linkage rod pivoted to the light source respectively, the second rod structure comprises a third linkage rod and a fourth linkage rod pivoted to the mounting plate respectively, and the bridge structure is pivoted to the first and second linkage rods respectively to make the first and second linkage rods swingable in parallel and is pivoted to the third and fourth linkage rods respectively to make the third and fourth linkage rods swingable in parallel;

wherein when the light source is lifted upward or is pressed downward relative to the display screen, the first and second linkage rods swing in parallel with movement of the light source to keep the first illumination boundary parallel to the front display surface or inclined outwardly at the first inclined angle;

when the light source is pulled forward or is pushed backward relative to the display screen, the third and fourth linkage rods swing in parallel with movement of the light source to keep the first illumination boundary parallel to the front display surface or inclined outwardly at the first inclined angle.

15. The display screen apparatus of claim 13, wherein the first rod structure is slidably disposed through the bridge structure and perpendicular to the front display surface, and the second rod structure is slidably disposed through the bridge structure and parallel to the front display surface;

wherein when the light source is pulled forward or pushed backward relative to the display screen, the first rod structure slides perpendicular to the front display surface relative to the bridge structure to keep the first illumination boundary parallel to the front display surface or inclined outwardly at the first inclined angle;

when the light source is lifted upward or pressed downward relative to the display screen, the bridge structure slides along the second rod structure parallel to the front display surface to keep the first illumination boundary parallel to the front display surface or inclined outwardly at the first inclined angle.

16. The display screen apparatus of claim 13, wherein the first rod structure comprises a first rod, a first pulley, a connection block and a belt, the second rod structure comprises a second rod, the bridge structure comprises a second pulley, the first pulley is pivoted to the first rod, the connection block is fixed to the first pulley and the light source respectively, the belt is wound on the first pulley and the second pulley, and the second pulley is non-rotatably connected to the second rod and pivoted to the first rod;

wherein when the first rod rotates in a direction relative to the second rod via the second pulley, the first pulley rotates in an opposite direction via engagement of the belt with the second pulley, and the light source rotates together with the first pulley via the connection block to keep the first illumination boundary parallel to the front display surface or inclined outwardly at the first inclined angle.

17. The display screen apparatus of claim 16, wherein the second rod structure further comprises a sliding block, the second rod is parallel to the front display surface and slidably disposed through the sliding block, the second pulley is non-rotatably connected to the sliding block, and when the light source is lifted upward or pressed downward relative to the display screen, the sliding block slides along the second rod parallel to the front display surface to keep the first illumination boundary parallel to the front display surface or inclined outwardly at the first inclined angle.

18. The display screen apparatus of claim 16, wherein the first rod structure further comprises a first sliding block, the bridge structure further comprises a second sliding block, the first pulley is pivoted to the first sliding block, the second pulley is pivoted to the second sliding block, and the first and second sliding blocks are slidably disposed on the first rod for adjusting a distance between the first pulley and the second pulley.

19. The display screen apparatus of claim 12, wherein connection of the mounting plate and the rear installation surface conforms to VESA (Video Electronics Standards Association) mount specification.

20. The display screen apparatus of claim 12, wherein the display screen apparatus further comprises a support arm or a support stand detachably assembled with the rear installation surface for mounting the display screen, and the mounting plate is connected to the support arm or the support stand to be detachably attached to the rear installation surface.

* * * * *